US005491771A

United States Patent [19]

Gupta et al.

[11] Patent Number: 5,491,771

[45] Date of Patent: Feb. 13, 1996

[54] REAL-TIME IMPLEMENTATION OF A 8KBPS CELP CODER ON A DSP PAIR

[75] Inventors: Prabhat K. Gupta, Germantown, Md.; Allan Lamkin, Arlington, Va.; Walter R. Kepley, III, Gaithersburg, Md.

[73] Assignee: Hughes Aircraft Company, Los Angeles, Calif.

[21] Appl. No.: 37,193

[22] Filed: Mar. 26, 1993

[51] Int. Cl.[6] ..... G10L 3/02; G10L 9/00

[52] U.S. Cl. ..... 395/2.32; 395/2.28

[58] Field of Search ..... 395/2.28, 2.32, 395/2.71, 2.73; 381/36–42

[56] References Cited

U.S. PATENT DOCUMENTS

| | | | |
|---|---|---|---|
| 4,641,238 | 2/1987 | Kneib | 395/325 |
| 4,817,157 | 3/1989 | Gerson | 381/40 |
| 4,868,867 | 9/1989 | Davidson et al. | 395/2.32 |
| 4,910,781 | 3/1990 | Ketchum et al. | 395/2.32 |
| 5,150,401 | 9/1992 | Asby, III et al. | 380/29 |
| 5,241,689 | 8/1993 | Schewd et al. | 455/54.1 |

OTHER PUBLICATIONS

Real Time Implementation and Performance of a 16 KB/S Low Delay Celp Speech Coder Chem IEEE/Apr. 1990.

A Pnver–Conserved Real–Time Speech Coder at Low Bit Rate Guan. IEEE/Jun. 1992.

TMS320C30 DSP Based Implementation of a Half Rate Celp Coder Wang et al. IEEE/Mar. 1992.

The Big Squeeze, A Celp Speech Codec Dettmer, IEEE Feb./1990.

*Primary Examiner*—Allen R. MacDonald

*Assistant Examiner*—Richemond Dorvil

*Attorney, Agent, or Firm*—Gordon R. Lindeen, III; Wanda K. Denson-Low

[57] ABSTRACT

A codec uses low cost digital signal processors (DSPs) to implement the codebook excited linear prediction (CELP) algorithm. The flexible architecture provides a platform for implementing a family of CELP codecs. In a specific example, an 8 Kbps CELP codec is partitioned into parallel tasks for real time implementation on dual DSPs with flexible intertask communication, prioritization and synchronization with asynchronous transmit and receive frame timings. The two DSPs are used in a master-slave pair. Each DSP has its own local memory. The DSPs communicate to each other through interrupts. Messages are passed through a dual port RAM. Each dual port RAM has separate sections for command-response and for data.

5 Claims, 4 Drawing Sheets

REAL-TIME IMPLEMENTATION OF A 8KBPS CELP CODER ON A DSP PAIR

BACKGROUND OF THE INVENTION

1. Field of the Invention

The present invention generally relates to digital voice communications systems and, more particularly, to a line spectral frequency vector quantizer for code excited linear predictive (CELP) speech encoders. Such devices are commonly referred to as "codecs" for coder/decoder. The invention has particular application in air-to-ground telephony but may be advantageously used in any product line that requires speech compression for communications.

2. Description of the Prior Art

Cellular telecommunications systems in North America are evolving from their current analog frequency modulated (FM) form towards digital systems. Digital systems must encode speech for transmission and then, at the receiver, synthesize speech from the received encoded transmission. For the system to be commercially acceptable, the synthesized speech must not only be intelligible, it should be as close to the original speech as possible.

Codebook Excited Linear Prediction (CELP) is a technique for low rate speech coding. The basic technique consists of searching a codebook of randomly distributed excitation vectors for that vector which produces an output sequence (when filtered through pitch and linear predictive coding CLPC) short-term synthesis filters) that is closest to the input sequence. To accomplish this task, all of the candidate excitation vectors in the codebook must be filtered with both the pitch and LPC synthesis filters to produce a candidate output sequence that can then be compared to the input sequence. This makes CELP a very computationally-intensive algorithm, with typical codebooks consisting of 1024 entries, each 40 samples long. In addition, a perceptual error weighting filter is usually employed, which adds to the computational load.

Fast digital signal processors (DSPs) have helped to implement very complex algorithms, such as CELP, in real-time. A number of techniques have been considered to mitigate the computational load of CELP encoders. For example, one strategy is a variation of the CELP algorithm called Vector-Sum Excited Linear Predictive Coding (VSELP). One VSELP codebook search method is disclosed in U.S. Pat. No. 4,817,157 by Gerson. Gerson addresses the problem of extremely high computational complexity for exhaustive codebook searching. The Gerson technique is based on the recursive updating of the VSELP criterion function using a Gray code ordered set of vector sum code vectors. The optimal code vector is obtained by exhaustively searching through the Gray code ordered code vector set. The Electronic Industries Association (EIA) in August 1991 adopted the Gerson VSELP codebook search method for the dual-mode mobile station, base station cellular telephone system compatibility standard. Although the Gerson search technique provides a notable reduction in computational complexity, it still requires a relatively expensive digital signal processor to implement, making the cost of the transceiver high.

Although the VSELP codebook search method has been adopted as the standard for mobile cellular telephone systems in the United States, no such standard presently exists for air-to-ground telephony. As the technology for this application of digital communications evolves, it is desirable to develop improved CELP processing techniques that would result in the best possible service for a competitive cost.

SUMMARY OF THE INVENTION

It is therefore an object of the present invention to provide a codec which implements the CELP algorithm using low cost DSPs.

It is another object of the invention to provide a flexible architecture for implementing a family of CELP codecs.

According to the present invention, an 8 Kbps CELP coder is partitioned into parallel tasks for real time implementation on dual DSPs with flexible intertask communication, prioritization and synchronization with asynchronous transmit and receive frame timings. The two DSPs are used in a master-slave pair. Each DSP has its own local memory. The DSPs communicate to each other through interrupts. Messages are passed through a dual port RAM having separate sections for command-response and for data.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
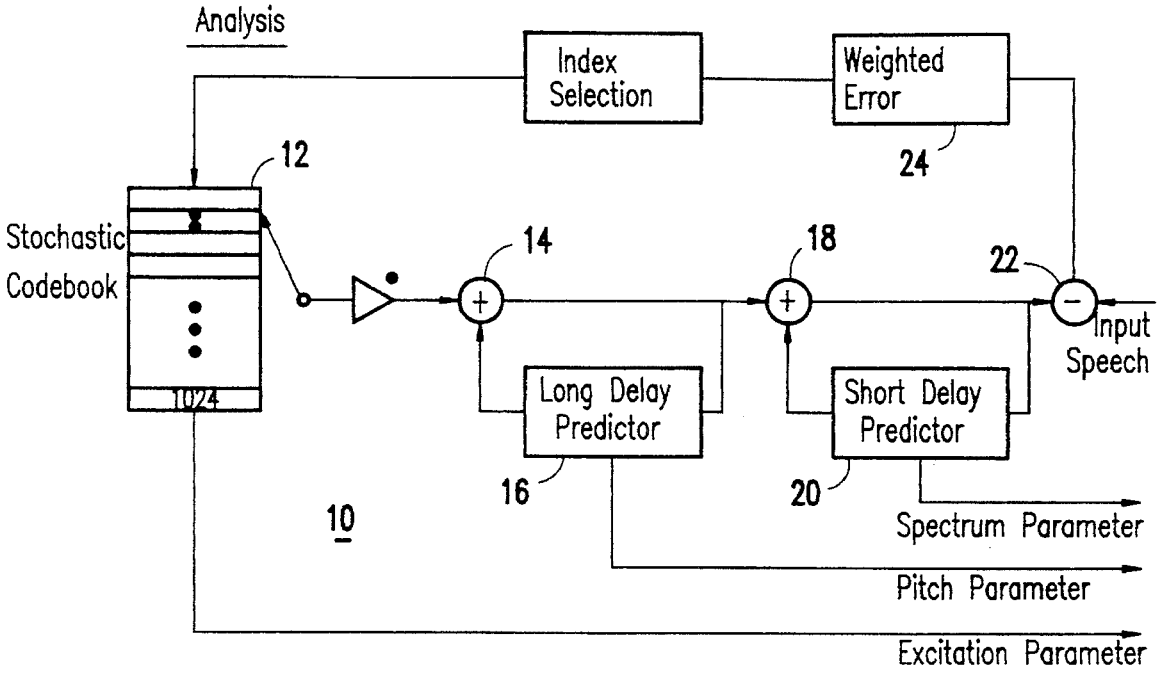
FIG. 1 is a block diagram showing a CELP encoder structure.

Referring now to the drawings, and more particularly to FIG. 1, there is shown a CELP encoder structure 10. CELP coding is based on linear prediction (LP) and perceptually weighted vector quantization (VQ) of an adaptive and stochastic codebook 12 using analysis-by-synthesis technique. The output of the codebook 12 is supplied to a summer 14 where it is summed with the output of a long delay pitch predictor 16. The output of the summer 14 is fed back to the long delay pitch predictor and to a second summer 18. At the second summer 18, the output of summer 14 is summed with the output of a short delay predictor 20. The output of summer 18 is fed back to the short delay predictor 20 and to difference circuit 22. The output of the second summer 18 is subtracted from the input speech signal in difference circuit 22 to generate an error signal, which is the difference between the synthesized speech from the codebook 12 and the input speech. This error signal is weighted in circuit 24, and the weighted error signal is used by index selection circuit to generate an address to the codebook 12.

The functions for the encoder are as follows:

Compute 10 coefficients of the short delay predictor 20 by using Linear Predictive Coding (LPC) analysis on non-overlapped frames of 20 ms duration.

Compute the coefficient of gain of the long delay pitch predictor 16 by minimizing the mean-squared prediction error after pitch prediction over every subframe of 4 ms.

Compute the excitation by searching the stochastic codebook 12 and minimizing a perceptually weighted mean square error every subframe of 4 ms.

The transmitted parameters are coded using 158 bits giving a rate of 7.9 Kpbs.

Figure 2:
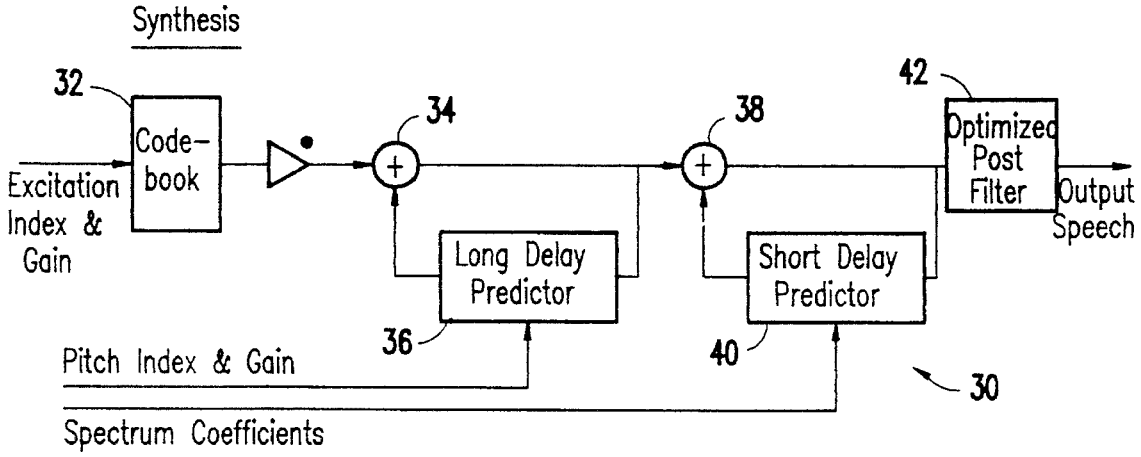
FIG. 2 is a block diagram showing a CELP decoder structure.

FIG. 2 shows the CELP decoder 30 which synthesizes the speech from the transmitted parameters. The excitation index and gain are input to a codebook 32, the output of which is supplied to a summer 34 where it is summed with the output of a long delay pitch predictor 36. The long delay pitch predictor 36 receives the transmitted pitch index and gain parameters. The output of the summer 34 is fed back to the long delay pitch predictor and to a second summer 38. At the second summer 38, the output of summer 34 is summed with the output of a short delay predictor 40. The short delay predictor 40 receives the transmitted spectrum coefficients. The output of summer 38 is fed back to the short delay predictor 40 and to an optimized post filter 42, the output of which is the synthesized speech.

The decoding algorithm performs the following functions:

Filter the excitation signal through the long delay predictor 36 to regenerate the fine pitch structure.

Restore the spectral envelope by filtering the regenerated excitation signal through the short delay predictor 40.

Post filter the synthetic output speech in filter 42 to enhance the quality.

The CELP characteristics are tabulated in Table 1.

TABLE 1

CELP Characteristics

| | Linear Prediction | Adaptive VQ | Stochastic VQ |
|---|---|---|---|
| Update | 20 ms | 4 ms | 4 ms |
| Parameters | 10 coefficients (RC) | 1 gain, 1 delay, 128 codewords | 1 gain, 1 index, 128 codewords |
| Analysis | open loop<br>10th order auto-correlation<br>20 ms Hamming window<br>no preemphasis<br>15 Hz expansion<br>interpolated by 5 | closed loop<br>32 divisional VQ<br>weighting = 0.8<br>range 20:147 | closed loop<br>32 dimensional VQ<br>shift by −2<br>weighting = 0.8<br>78% sparsity<br>ternary samples |
| Bits/frame | 38 | index: 5 × 7<br>gain: 5 × 5 | index: 5 × 7<br>gain: 5 × 5 |
| Rate (bps) | 1900 | 3000 | 3000 |

Input speech is anti-aliased filtered and sampled at 8 kHz as 8-bit μ-law samples. The samples are collected in frames of 20 ms (160 samples), converted to linear format and high pass filtered using second order IIR (infinite-duration-impulse-response) filter with a transform function:

$$H(z)=\frac{1-2z^{-1}+z^{-2}}{1-1.8891z^{-1}+0.89503z^{-2}}. \quad (1)$$

The cutoff frequency is 150 Hz with 30 dB attenuation at 50 Hz. If necessary, the speech buffer is echo canceled before processing.

The short term filter is equivalent to the traditional LPC synthesis filter:

$$A(z)=\frac{1}{1-\sum_{i=1}^{N_p}\alpha_i z^{-1}}. \quad (2)$$

The LP analysis is performed once per frame by open-loop, tenth order autocorrelation analysis using a 20 ms Hamming window, no preemphasis, and 15 Hz bandwidth expansion. The bandwidth expansion operation replaces the direct form filter coefficients $\alpha_i$, with $\alpha_{i\gamma}{}^{i}$, where the weighting factor $\gamma^i$=0.994. This widens the bandwidth of the formats by moving the poles radially towards the origin of the z-plane which helps to reduce bandwidth underestimation and improve speech quality and coefficient quantization. The perceptually weighted filter $$W(z)=\frac{A(z)}{A\left(\frac{z}{\gamma}\right)},$$

The LP analysis introduces an algorithmic delay of 10 ms because the analysis window is centered at the end of the last frame. The filter coefficients are converted to LSPs and linearly interpolated with the last frame parameters to form an intermediate set for each of the five subframes of the analysis window. The filter coefficients are then converted to RCs for transmission and quantized using 38-bit, independent non-uniform scalar quantization.

The adaptive codebook search is performed by closed-loop analysis using modified squared prediction error (MSPE) criteria of the perceptually weighted error signal. The codebook is updated by the excitation signal used in the present subframe for use in the following subframe and thus contains a history of past excitation signals. The codebook has a shift of one sample between codewords as no fractional pitch is used. The codeword with index i is formed by the vector which starts i samples back in time. For delays less than the vector length of L=32 (4 ms), codewords are formed by replicating the short vector.

Let the excitation vector be represented by $v^{(i)}=g_i X^{(i)}$, where $g_i$ is the gain associated with the codebook vector $x^{(i)}$. Let H and W be L×L matrices whose j-th rows contain the truncated impulse response caused by a unit impulse δ(t-J) of the LP filter and error weighting filter, respectively. The synthetic speech can be expressed as the LP filter's zero input response, $\bar{S}^{(0)}$, plus the convolution of the LP filter's excitation and impulse response:

$$\bar{s}^{(i)}=\bar{s}^{(0)}+v^i H \quad (3)$$

The weighted error signal is $$e^{(I)}=(s-\bar{s}^{(i)})W \tag{4}$$

or $$e^{(i)}=e^{(0)}-y^{(i)}HW \tag{5}$$

The target is $$e^{(0)}=(s-\bar{s}^{(0)})W \tag{6}$$

Thus, the weighted error is the target minus the scaled filtered codeword:

$$e^{(i)}=e^{(0)}-g_i y^{(i)}, \tag{7}$$

where $y^{(i)}$ represents the filtered codeword:

$$y^{(i)}=x^{(i)}HW. \tag{8}$$

Minimizing the total squared error $\|e^{(i)}\|$ for codeword i with respect to the gain value $g_i$ results in an optimum gain value which is the ratio of the crosscorrelation of the target and filtered codeword to the energy of the filtered codeword:

$$g_{(i)}=\frac{(e^{(0)}y^{(i)T})^2}{y^{(i)}y^{(i)T}}. \tag{9}$$

Also, ignoring gain quantization, minimizing the total squared error is equivalent to maximizing the match score:

$$\text{match}_{(i)}\approx\frac{(e^{(0)}y^{(i)T})^2}{y^{(i)}y^{(i)T}}. \tag{10}$$

For every subframe, the search is performed on 128 integer delays from 20 (400 Hz) to 147 (54.4 Hz). The gain is coded between −2 and +2 using absolute, nonuniform, nonsysmetric 5-bit quantization.

The stochastic code book search is performed by closed loop analysis using conventional MSPE criteria of the perceptually weighted error signal. The codebook consists of zero-mean, unit-variance, white Gaussian sequences center clipped to generate a 78% sparse, overlapped by −2, ternary valued codebook. This facilitates fast convolution and energy computations by exploiting recursive end-point correction algorithms.

The search for the optimum index and gain is similar to the adaptive codebook search, except that the filtered adaptive code book VQ excitation is subtracted from the first stage target vector:

$$e^{(0)}=(s-\bar{s}^{(0)})W-uHW. \tag{11}$$

The codebook length is 128 requiring seven bits for transmission across the channel. The codebook gain is coded using a 5-bit, absolute, nonuniform symmetric scalar quantizer.

An adaptive postfilter is used to reduce perceptual coder noise. The postfilter emphasizes the spectral regions predicted by the short-term LPC analysis. This tends to mask coder noise by concentrating it under the format peaks. Adaptive spectral tilt compensation is applied to flatten the overall tilt of the postfilter.

On the receive side, the slip buffer of ±10 ms (80 samples or 640 bits) is implemented to allow for variations in the transmit and receive clocks. If necessary, noise suppression is also done on the output buffer by using a voice activity detector. Next, the samples are converted to 8-bit μ-law and output to the digital-to-analog (D/A) converter.

Figure 3:
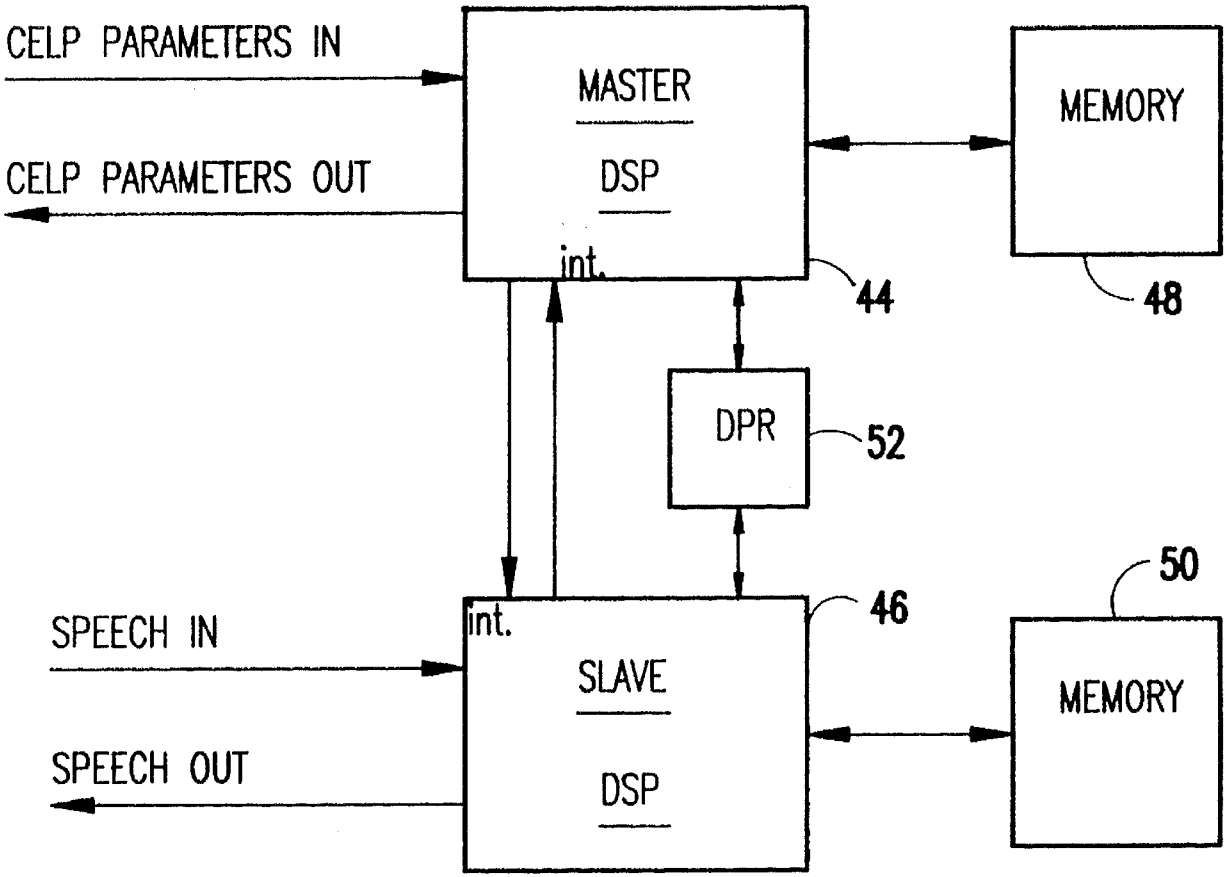
FIG. 3 is a block diagram showing the architecture of the CELP codec according to the present invention.

FIG. 3 is a block diagram showing the architecture of the CELP coder according to the invention. Two DSPs 44 and 46 are used in a master-slave pair to implement all the functions described above. The DSP 44 is designated the master, and DSP 46 is the slave. Each DSP 44 and 46 has its own local memory 48 and 50, respectively. A suitable DSP for use as DSPs 44 and 46 is the Texas Instruments TMS320C31 DSP. The DSPs communicate to each other through interrupts. Messages are passed through a dual port RAM 52. Dual port RAM 52 has separate sections for command-response and for data.

The main computational burden for the speech coder is adaptive, and stochastic code book searches on the transmitter, as illustrated in FIG. 1, is shared between DSPs 44 and 46. DSP 44 implements the remaining encoder functions. All the speech decoder functions, as illustrated in FIG. 2, are implemented on DSP 46. The echo canceler and noise suppression are implemented on DSP 46 also.

The data flow through the DSPs is as follows for the transmit side. DSP 46 collects 20 ms of/x-law encoded samples and converts them to linear values. These samples are then echo canceled and passed on to DSP 44 through the dual port RAM 52. The LPC analysis is done in DSP 44. It then computes the e(0) and h vectors for each subframe and transfers it to DSP 46 over the dual port RAM 52. DSP 46 is then interrupted and assigned the task to compute the best index and gain for the second half of the codebooks. DSP 44 computes the best index and gain for the first half of the codebook and chooses between the two based on the match score. DSP 44 also updates all the filter states at the end of each subframe and computes the speech parameters for transmission.

Figure 4:
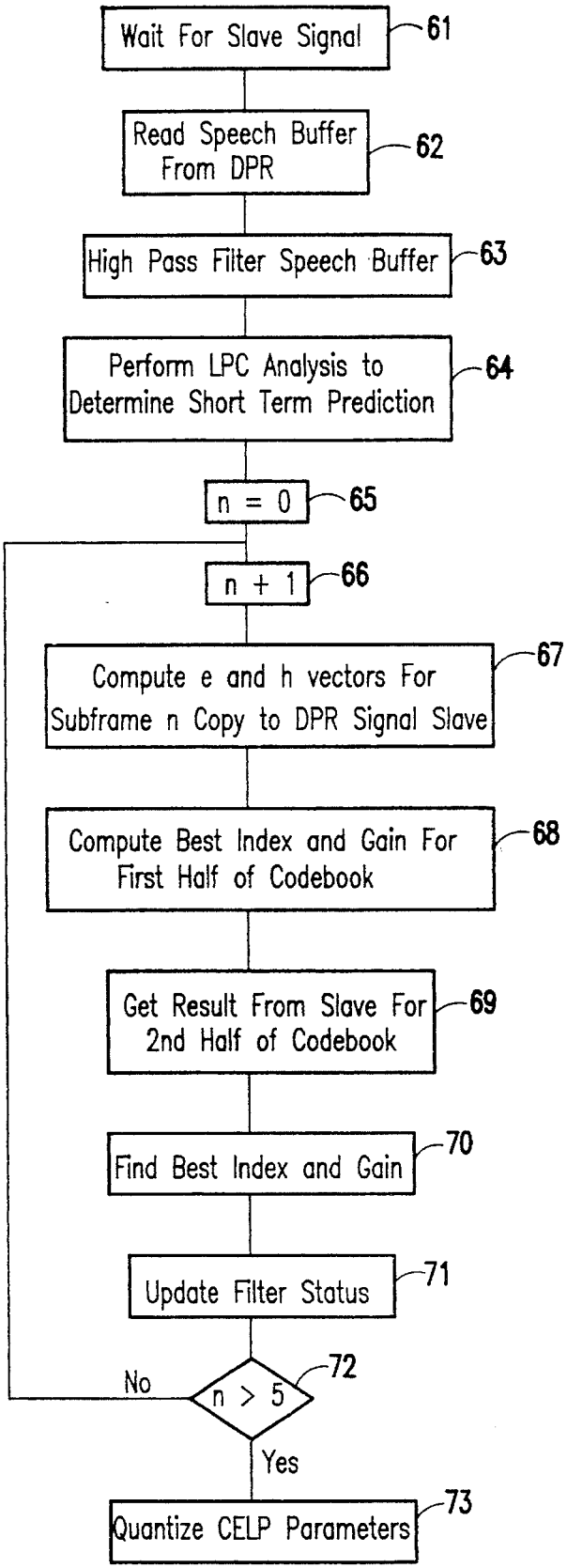
FIG. 4 is a flow diagram showing the logic of the processing of the master DSP of FIG. 3.

The logic of the process for the DSP 44 is shown in the flow diagram of FIG. 4, to which reference is now made. In function block 61, DSP 44 waits for a slave interrupt signal, and when a slave interrupt signal is received, the speech buffer from DSP 46 is read via the dual port RAM 52 in function block 62. The speech in the speech buffer is high pass filtered in function block 63, and then the DSP 44 performs an LPC analysis in function block 64 to determine the short term prediction. At this point, the process enters a loop which is initialized by setting n to zero in function block 65, and for each repetition of the loop, n is incremented by one in function block 66. In the loop, at function block 67, the e(0) and h vectors are computed for each subflame n and copied to DSP 46 via dual port memory 52, DSP 46 being notified via the interrupt. Next, in function block 68, DSP 44 computes the best index and gain for the first half of the codebook. At the same time, DSP 46 is notified to compute the best index and gain for the second half of the codebook. The result of the computation by DSP 46 is retrieved via the dual port RAM 52 in function block 69. With these results, DSP 44 finds the best index and gain in function block 70 and updates the filter status in function block 71. Then a test is made in decision block 72 to determine if n is greater than five. If not, n is again incremented by one in function block 66, and the loop repeated. If on the other hand, n is greater than five, the CELP parameters are quantized in function block 73.

Figure 5A:
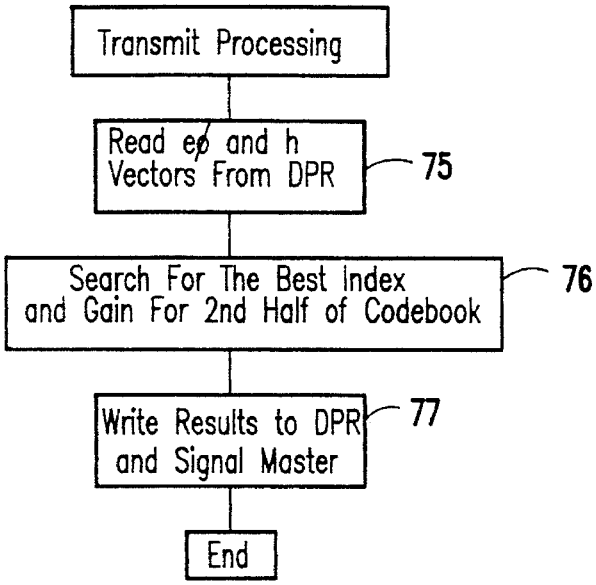
FIGS. 5A, 5B and 5C are flow diagrams showing the logic of the processing of the slave DSP shown in FIG. 3.

FIG. 5A shows the transmit processing performed by DSP 46. As mentioned, DSP 44 computes the e(0) and h vectors and copies them to the dual port RAM 52. In function block 75, DSP 46 reads the computed vectors from the dual port RAM. DSP 46 then searches for the best index and gain for the second half of the codebook in function block 76, and the results of the search are reported to DSP 44 via the dual port RAM 52 in function block 77.

Figure 5B:
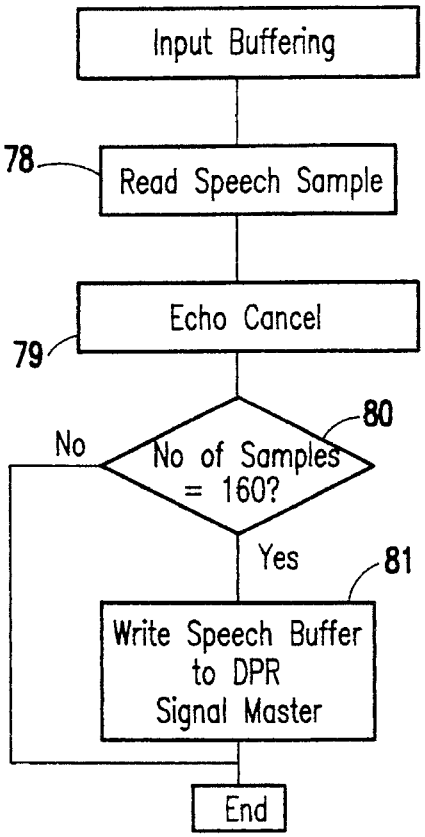

FIG. 5B shows the input buffering performed by DSP 46. DSP 46 gets the speech parameters. Speech samples are read in function block 78, and echo canceling is performed in function block 79. A test is then made in decision block 80 to determine if the number of samples is equal to 160. If so, the speech buffer is written to the dual port RAM 52, and the master DSP 44 is signalled via the interrupt in function block 81.

Figure 5C:
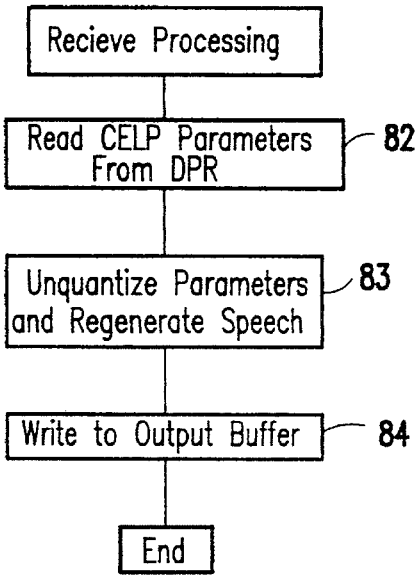

The data flow on the receive side is shown in FIG. 5C. DSP 46 gets the received speech parameters in function block 82. If errors are detected, the parameters are smoothed and then decoded to generate the reconstructed speech in function block 83. Noise in the output speech is suppressed if necessary. The regenerated speech data is then written to the output buffer in function block 84.

Synchronization is maintained by giving the transmit functions higher priority over receive functions. Since DSP 44 is the master, it preempts DSP 46 to maintain transmit timing. DSP 46 executes its task in the following order: (i) transmit processing, (ii) input buffering and echo cancellation, and (iii) receive processing and voice activity detector.

The loading of the DSPs is tabulated in Table 2.

TABLE 2

| Maximum Loading for 20 ms frames | | |
|---|---|---|
| | DSP 44 | DSP 46 |
| Speech Transmit | 19 | 11 |
| Speech Receive | 0 | 4 |
| Echo Canceler | 0 | 3 |
| Noise Suppression | 0 | 3 |
| Total | 19 | 19 |
| Load | 95% | 95% |

While the invention has been described in terms of a single preferred embodiment, those skilled in the art will recognize that the invention can be practiced with modification within the spirit and scope of the appended claims.

What is claimed is:

1. A codebook excited linear prediction (CELP) codec comprising a master processor receiving and generating CELP parameters and a slave processor receiving speech samples and outputting regenerated speech, said master and slave processors communicating via mutually connected interrupts and a dual port random access memory (RAM) connected between said master and slave processors for temporarily storing messages passed between said master and slave processors, said master and slave processors sharing a stochastic and adaptive code book search, said master processor performing encoding of speech processed by said slave processor and stored in said dual port RAM based on said code book search, and said slave processor performing input buffering and speech decoding based on the CELP parameters generated by said master processor and stored in said dual port RAM.

2. The CELP codec recited in claim 1 wherein said slave processor reads speech samples and writes speech data to said dual port RAM and said master processor reads speech data in said dual port RAM and performs a linear predictive coding (LPC) analysis to determine a short term prediction.

3. The CELP codec recited in claim 2 wherein said master processor computes CELP vectors and writes said CELP vectors to said dual port RAM and notifies said slave processor by an interrupt, said master processor then computes a best index and gain for a first portion of said code book search and said slave processor reads said CELP vectors in said dual port RAM and computes a best index and gain for a second portion of said code book search and writes said best index and gain for the second portion of said code book search in said dual port RAM and notifies said master processor by an interrupt.

4. The CELP codec recited in claim 3 wherein said master processor reads said best index and gain for the second portion of said code book search in said dual port RAM and determines a best index and gain from the best indices and gains computed by said master and slave processors, said master processor quantizing CELP parameters based on said best index and gain, said quantized CELP parameters being used to transmit encoded speech data to a receiver.

5. The CELP codec recited in claim 4 wherein said master processor writes said quantized CELP parameters to said dual port RAM, said slave processor reads said quantized CELP parameters from said dual port RAM and regenerates received encoded speech signals using said quantized CELP parameters.

* * * * *